US007410211B1

(12) United States Patent
Lin et al.

(10) Patent No.: US 7,410,211 B1
(45) Date of Patent: Aug. 12, 2008

(54) FOLDING CHAIR WITH WHEELS

(76) Inventors: Mei Chuen Lin, 9F, No. 275-1, Yuan-Hua Road, Chung-Li City, Taoyuan Hsien (TW); Tzu Mei Wang, 9F, No. 275-1, Yuan-Hua Road, Chung-Li City, Taoyuan Hsien (TW)

( * ) Notice: Subject to any disclaimer, the term of this patent is extended or adjusted under 35 U.S.C. 154(b) by 0 days.

(21) Appl. No.: 11/672,136

(22) Filed: Feb. 7, 2007

(51) Int. Cl.
*A47C 4/00* (2006.01)
*B60B 33/00* (2006.01)
*B60B 33/02* (2006.01)

(52) U.S. Cl. ..... 297/23; 297/16.1; 297/55; 297/56; 16/31 A; 16/31 R; 16/35 R; 16/43

(58) Field of Classification Search ..... 297/23, 297/55, 56, 57, 59; 16/31 A, 31 R, 35 R, 16/43
See application file for complete search history.

(56) References Cited

U.S. PATENT DOCUMENTS 1,600,248 A * 9/1926 Rosenthal et al. ..... 297/56
2,548,098 A * 4/1951 Clarin ..... 297/30
2,675,062 A * 4/1954 Clarin ..... 297/41
2,982,339 A * 5/1961 Clarin ..... 297/56
3,001,816 A * 9/1961 Clarin ..... 297/56
3,640,568 A * 2/1972 Suzuki et al. ..... 297/239 X
3,704,025 A * 11/1972 Cerveny et al. ..... 297/DIG. 4 X
3,889,963 A * 6/1975 Brattgard ..... 297/DIG. 4 X
4,025,088 A * 5/1977 Rothschild ..... 297/DIG. 4 X
4,118,065 A * 10/1978 Watkins ..... 297/DIG. 4 X
4,229,039 A * 10/1980 Day ..... 297/DIG. 4 X
4,266,305 A * 5/1981 Kavaloski et al. ... 297/DIG. 4 X
4,369,987 A * 1/1983 Witherell ..... 280/644
4,415,177 A * 11/1983 Hale et al. ..... 297/DIG. 4 X
4,449,732 A * 5/1984 Surot ..... 280/644
4,640,525 A * 2/1987 Jensen et al. ..... 280/642
4,678,202 A * 7/1987 Jensen et al. ..... 297/59 X
4,695,072 A * 9/1987 Brooks ..... 280/650
4,824,167 A * 4/1989 King ..... 297/16.1
4,892,327 A * 1/1990 Cabagnero ..... 297/56 X
4,907,794 A * 3/1990 Rose ..... 280/43.24 X
4,934,719 A * 6/1990 duPont ..... 280/47.131
5,020,560 A * 6/1991 Turbeville ..... 280/282 X
5,050,862 A * 9/1991 Saghafi ..... 280/87.051 X
5,104,180 A * 4/1992 Takahashi et al. ..... 297/16.1
5,110,183 A * 5/1992 Jeanes, III ..... 297/343
5,263,728 A * 11/1993 Patel et al. ..... 280/42 X
5,584,529 A * 12/1996 Cheng ..... 297/59 X
5,603,517 A * 2/1997 Lorman ..... 280/641

(Continued)

*Primary Examiner*—Rodney B. White
(74) *Attorney, Agent, or Firm*—Rabin & Berdo, P.C.

(57) ABSTRACT

A folding chair with wheels includes a backrest, a seat, a front leg frame and a rear leg frame pivotally connected to both sides of the seat, a plurality of wheel assemblies and a plurality of connection blocks. Each of the front leg frame and the rear leg frame comprises a groove at a side surface thereof. The wheel assembly includes a wheel, a bearing and a threaded stem screwed into the connection block. The connection block has a plurality of connection screw holes, and is screwed onto the grooves of the front leg frame and the rear leg frame by bolts. The wheel assemblies connected with the front leg frame and the rear leg frame are disposed at the external side and the internal side of the folding chair, respectively. Therefore, the wheel assemblies do not interfere with each other when the chair is folded.

4 Claims, 7 Drawing Sheets

U.S. PATENT DOCUMENTS 5,716,063 A * 2/1998 Doyle et al. ..... 280/87.05
6,183,002 B1 * 2/2001 Choi et al. ..... 280/647
6,311,708 B1 * 11/2001 Howle ..... 280/641 X
6,736,450 B2 * 5/2004 Miyagi ..... 297/59 X
6,742,839 B2 * 6/2004 Piretti ..... 297/55 X
6,752,414 B1 * 6/2004 Waldron et al. ..... 297/16.2 X
6,755,468 B1 * 6/2004 Pan ..... 297/239 X
7,147,286 B2 * 12/2006 Cesaroni et al. ..... 297/239 X
7,162,772 B2 * 1/2007 Asher ..... 16/31 R X
7,226,123 B1 * 6/2007 Lin et al. ..... 297/56
7,296,853 B2 * 11/2007 Piretti ..... 297/239
2005/0110308 A1 * 5/2005 Church et al. ..... 297/16.1

* cited by examiner

FOLDING CHAIR WITH WHEELS

BACKGROUND OF THE INVENTION

1. Field of the Invention

The present invention relates to a folding chair, and in particular to a folding chair provided with wheels that is easy to move.

2. The Prior Arts

Referring to FIG. 7, a conventional folding chair used in an office or a conference room is made of metal, and comprises a front leg frame, a rear leg frame, and a seat pivotally connected between the front leg frame and the rear leg frame. The folding chair does not take much room when it is folded. However, because the metal folding chair is heavy, it is exhausting to move them in quantity. Furthermore, because the folding chair is not equipped with wheels, a user can not sit in the folding chair and glide the chair to grab something close by. If the user sitting in the folding chair wants to move the chair by a short distance, he or she needs to stand up to move the chair. Therefore, there is a need to provide the folding chair with wheels.

Referring to FIG. 6, an office chair sold in the market includes a seat A, a backrest B, a base D, an adjustable post C mounted between the base D and the seat A, and a plurality of wheels E equally disposed beneath the base D. The office chair overcomes the disadvantage of chairs without wheels, but it is unfoldable. Thus, the office chair takes up a lot of room to store or move when it is not in use. Furthermore, the wheels E are screwed into the base D. Bolts and screw holes are worn out after long time use, and thus the wheels E are then loosened or even fail to function. The base D and the wheels E will need to be replaced after the bolts and the screw holes are worn out.

SUMMARY OF THE INVENTION

A folding chair with wheels is still not available in the market. Thus, a primary objective of the present invention is to provide a folding chair with wheels at the legs of the chair. Not only are the wheels for easy mobility, but also the wheels do not interfere with each other when the chair is folded. The folding chair takes up less room to store and move than the conventional chairs. The folding chair with wheels is improvements over the conventional chair.

The folding chair with wheels according to the present invention comprises a backrest, a seat and a front leg frame, a rear leg frame pivotally mounted to the both sides of the seat. Each of the front leg frame and the rear leg frame includes a groove on a side surface thereof.

The chair further comprises a plurality of wheel assemblies and connection blocks having a plurality of through screw holes. The wheel assembly comprises a threaded stem screwed into the bottom of the connection block, and a bearing mounted on the threaded stem.

The connection blocks are screwed on the bottom surface of the grooves of the front leg frame and the rear leg frame, thereby connecting the wheel assemblies to the outside of the front leg frame and inside of the rear leg frame. The bearing allows the threaded stem and wheel to rotate. Therefore, the user can sit in and glide the folding chair.

The difference between the folding chair according to the present invention and the conventional folding chair is that the folding chair according to the present invention is provided with the wheels at the ends of the front leg frame and the rear leg frame. If the user wants to move the chair to another location, the wheels make dragging the chair easier. When the user sitting in the chair wants to slightly move the chair or grab something close by, the user can keep sitting in the chair and glide around. Therefore, it saves time.

Furthermore, the wheels are mounted on the front leg frame and the rear leg frame by connection blocks. The structure of the connection block is simple. Thus, the connection blocks do not take up much space, and the chair is not heavy. Besides, the front wheels and the rear wheels are mounted on the outside of the front leg frame and the inside of the rear leg frame, respectively. The front and rear wheels do not interfere with each other, when the chair is folded. Moreover, when the threaded stems and screw holes are worn out, it only needs to replace wheel assemblies and the connection blocks.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
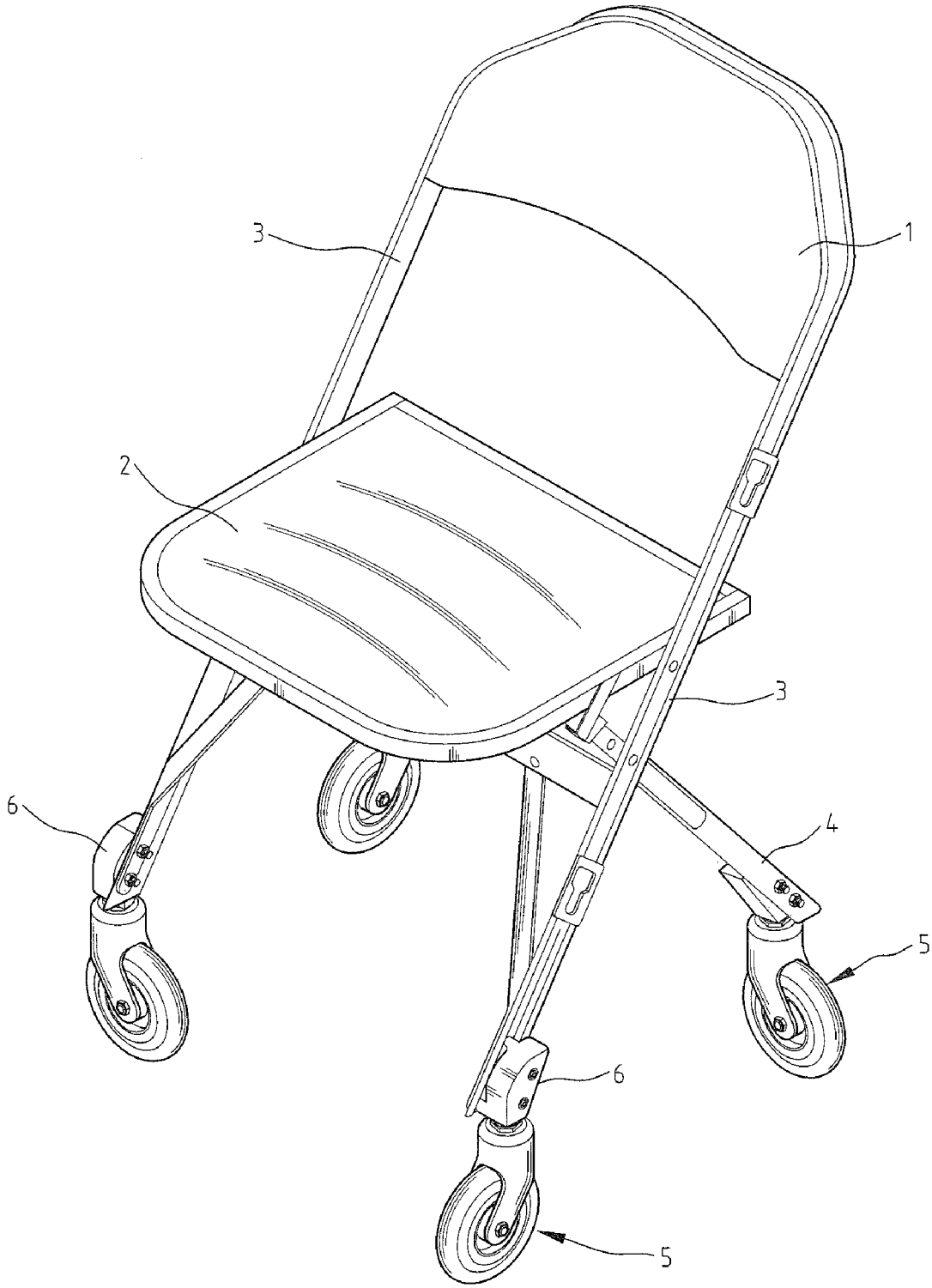
FIG. 1 is an assembled view showing a folding chair with wheels according to a first embodiment of the present invention.
Figure 2:
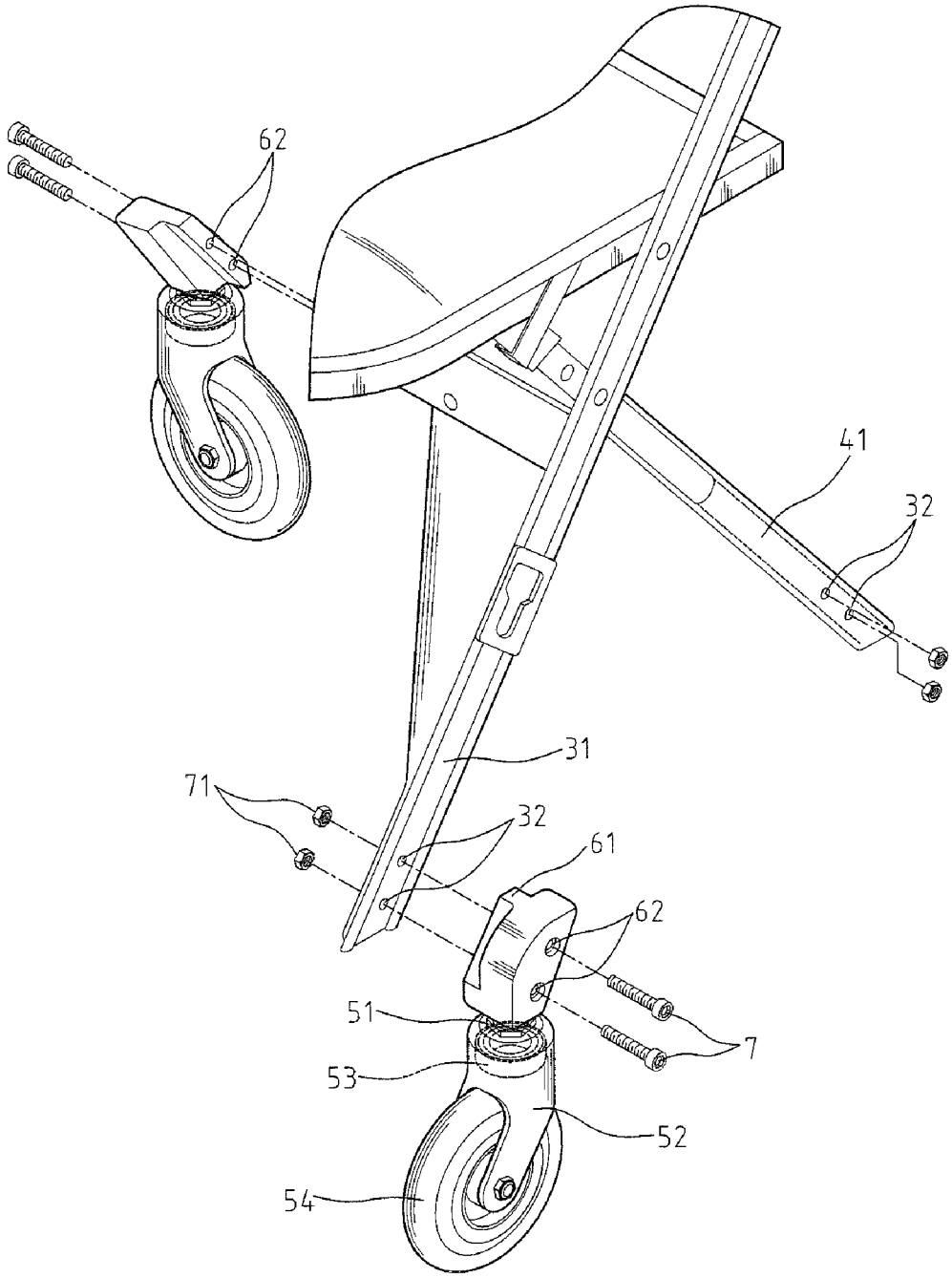
FIG. 2 is a partial exploded view showing the folding chair with wheels according to the first embodiment of the present invention.

Referring to FIGS. 1 and 2, a folding chair with wheels according to the present invention comprises a backrest 1, a seat 2, a front leg frame 3 as well as a rear leg frame 4 pivotally connected to both sides of the seat 2, and a plurality of wheel assemblies 5 mounted at the ends of the front leg frame 3 and the rear leg frame 4.

A curved ridge is disposed at each edge of the front leg frame 3 at an external side, and a curved ridge is disposed at each edge of the rear leg frame 4 at an internal side. A groove 31 and a groove 41 are formed between the two curved ridges of the front leg frame 3 and rear leg frame 4, respectively. Each ends of the grooves 31 and 41 comprises a plurality of through holes 32.

The folding chair further comprises a plurality of connection blocks 6 connecting the wheel assemblies 5 to the front leg frame 3, and the rear leg frame 4. The connection block 6 comprises a ridge 61, whose width is slightly narrower than that of the grooves 31, 41, and a plurality of connection screw holes 62 corresponding to the leg through holes 32. The connection screw holes 62 pass through the ridge 61 of the connection block 6. The connection block 6 further comprises a stem screw hole at the bottom thereof.

The wheel assembly 5 includes a threaded stem 51 corresponding to the stem screw hole, a wheel fork 52, a bearing 53 connected with the threaded stem 51 and disposed inside the wheel fork 52, and a wheel 54 pivotally connected within the wheel fork 52.

When assembling the folding chair with wheels, first of all, the threaded stem 51 is screwed into the stem screw hole of the connection block 6. The wheel 54 can rotate 360° because of the bearing 53. Secondly, the ridges 61 of the connection blocks 6 are fitted into the grooves 31 and 41 of the front leg frame 3 and the rear leg frame 4; the connection screw holes 62 of the connection block 6 are aligned with the through holes 32 of the front leg frame 3 and the rear leg frame 4. Thirdly, bolts 7 pass through the connection screw holes 62 and the through holes 32 in turn, and are held in place by nuts 71 on the other side. Therefore, the connection blocks 6 connect the wheel assemblies 5 to the front leg frame 3 and the rear leg frame 4.

Figure 3:
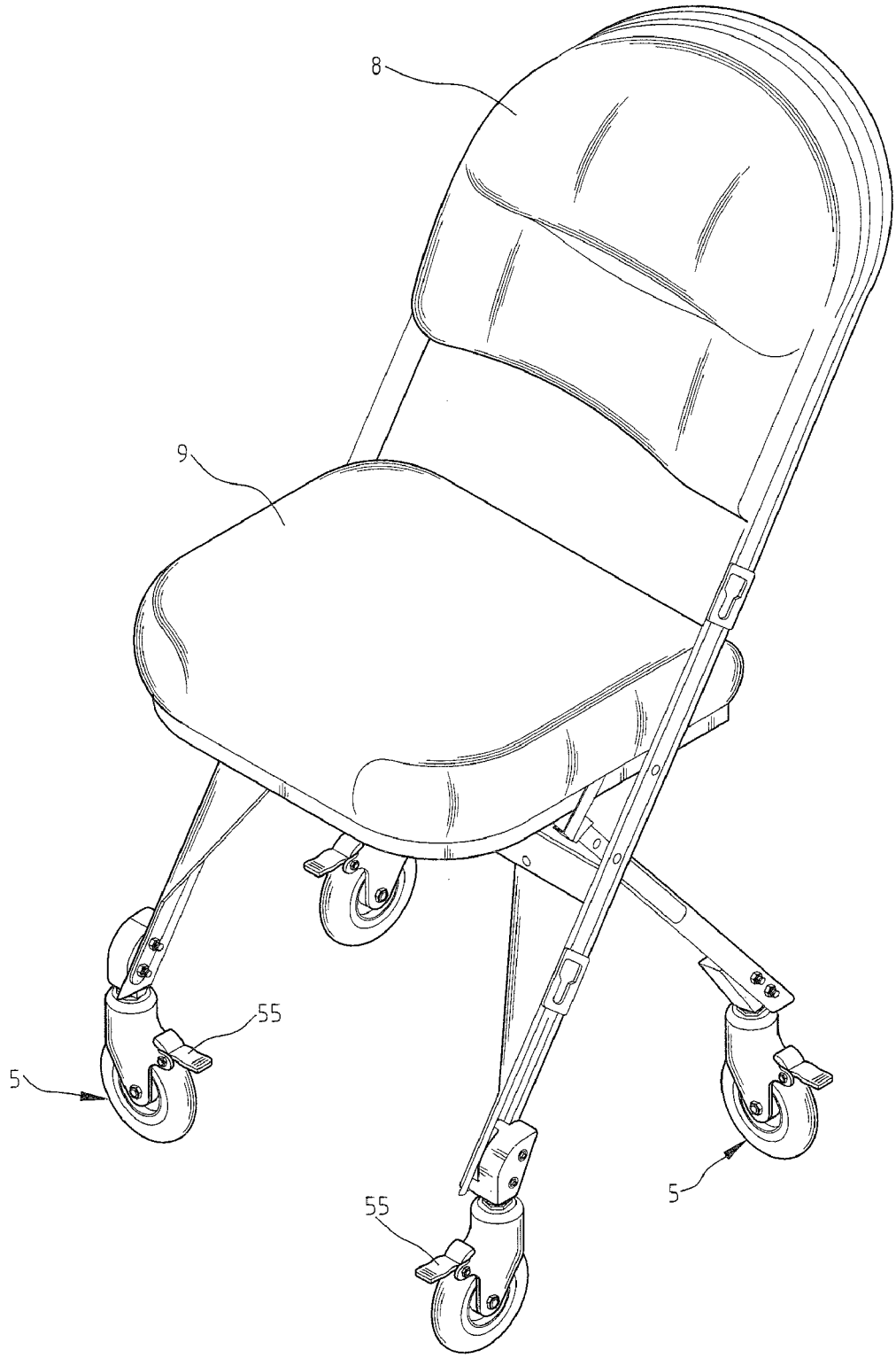
FIG. 3 is an assembled view showing a folding chair with wheels according to a second embodiment of the present invention.

FIG. 3 illustrates another embodiment of the folding chair with wheels according to the present invention. The wheel assembly 5 further comprises a foot brake 55 to lock the wheel 5. Moreover, a backrest 8 and a seat 9 maybe padded.

Figure 4:
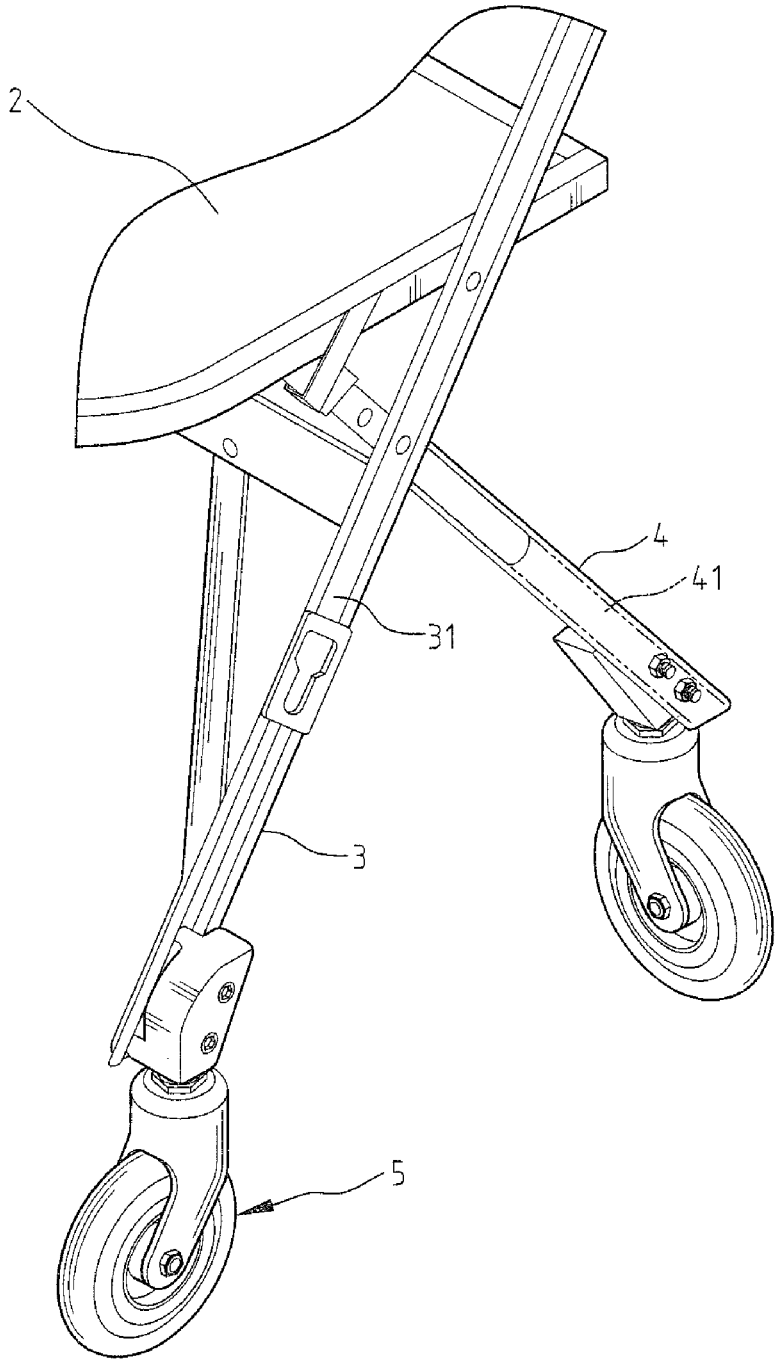
FIG. 4 is a partial detailed view showing the folding chair with wheels according to the first embodiment of the present invention in use.
Figure 5:
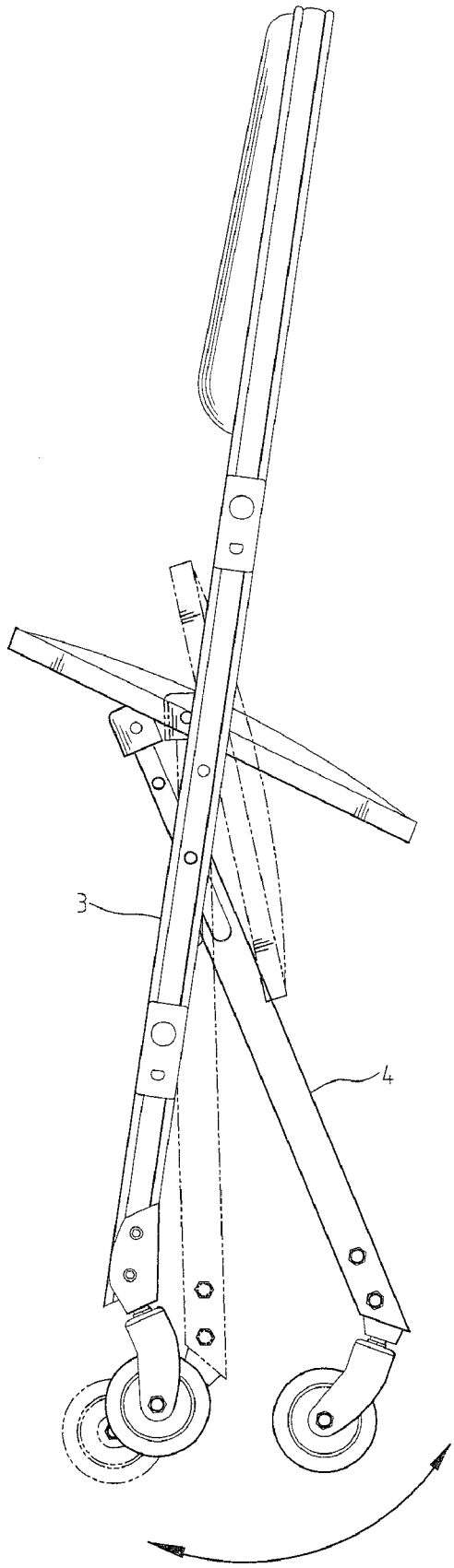
FIG. 5 is a schematic view showing folding and unfolding of the folding chair with wheels according to the first embodiment of the present invention.
Figure 6:
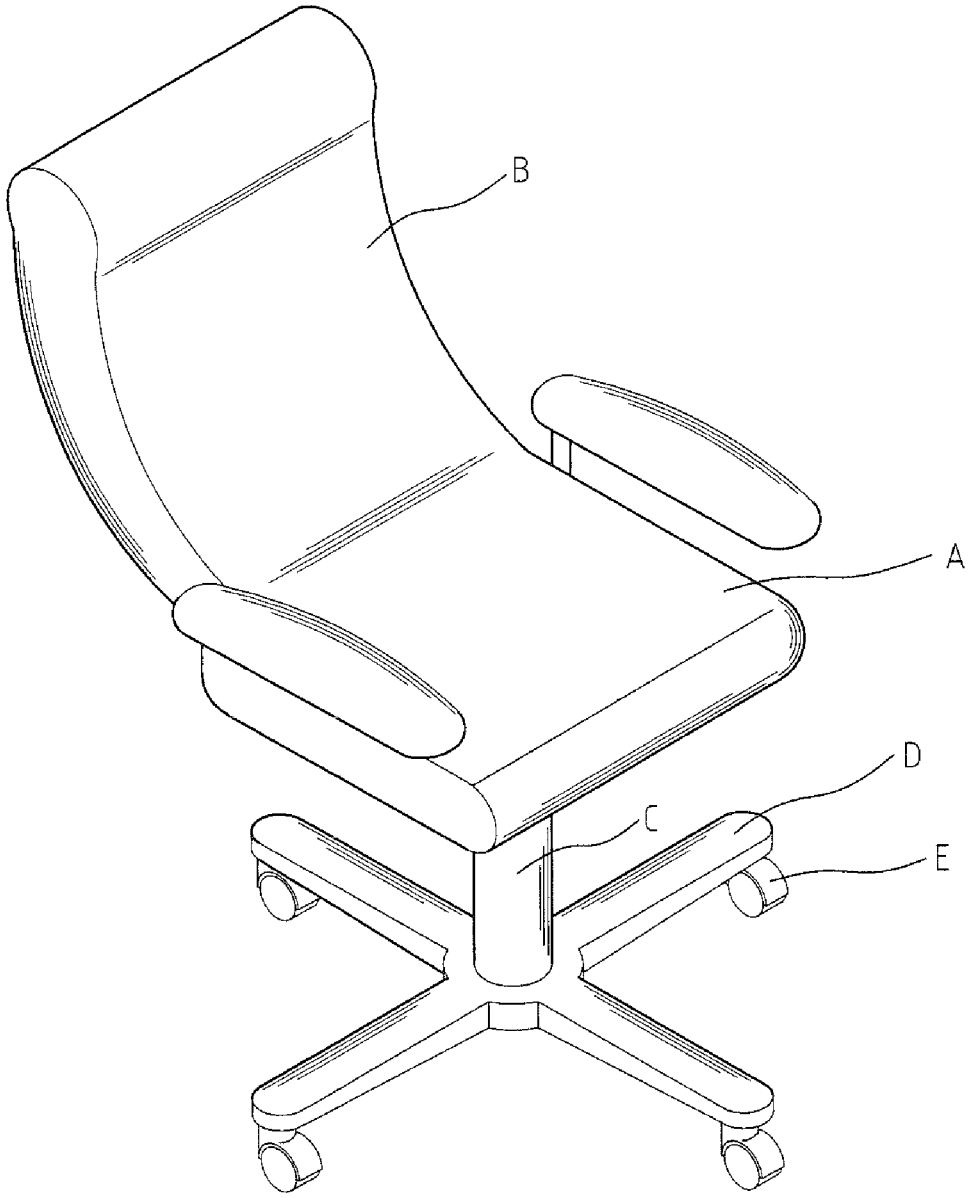
FIG. 6 (PRIOR ART)
FIG. 6 is a perspective view of a conventional office chair.
Figure 7:
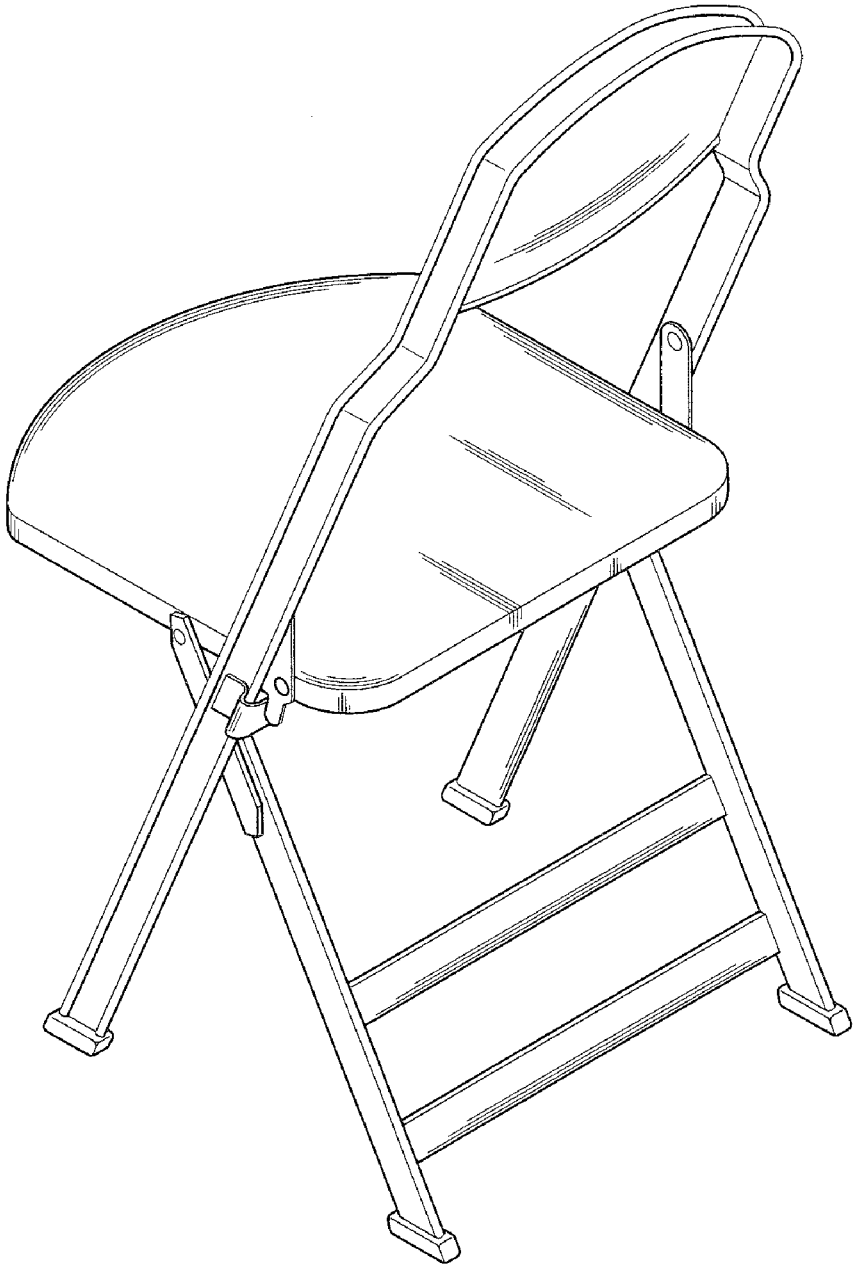
FIG. 7 (PRIOR ART)
FIG. 7 is a perspective view showing a conventional folding chair.

FIG. 4 is a partial detailed view showing the folding chair with wheels according to the first embodiment in use, and FIG. 5 is a schematic view showing folding and unfolding of the folding chair with wheels according to the first embodiment of the present invention. The groove 31 is disposed at the external side of the front leg frame 3 (an external side of the folding chair), and the groove 41 is disposed at the internal side of the rear leg frame 4 (an internal side of the folding chair). The connection blocks 6 are fitted into the grooves 31 and 41. Thus, the wheel assemblies 5 mounted on the front leg frame 3 are located at the external side of the folding chair, and the wheel assemblies 5 mounted on the rear leg frame 4 are located at the internal side of the folding chair. Therefore, when the folding chair according to the present invention is folded, the wheel assemblies 5 mounted at the front leg frame 3 and the rear leg frame 4 do not interfere with each other.

The user can sit in the folding chair with wheels according to the present invention, and glide to any place close by without standing up. Because the folding chair is equipped with the wheels, it is easier to drag the folded chair to any place. At the same time, the folding chair according to the present invention uses the connection blocks 6 to connect the wheel assemblies 5 with the front leg frames 3 and rear leg frame 4. It is different from the conventional office chair that the wheel assemblies are screwed into the base directly. When the screws and screw holes are wom out, the folding chair with wheels according to the present invention only needs to replace the wheel assemblies 5 and the connection blocks 6, but the conventional office chair needs to replace the wheel assemblies E and the base D. Replacing the connection blocks 6 is cheaper than replacing the base D.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A folding chair with wheels, comprising:

a backrest;

a seat;

a front leg frame and a rear leg frame pivotally connected to both sides of the seat, each of the front leg frame and the rear leg frame having a groove at a side surface thereof;

a plurality of connection blocks, each connection block having a ridge complementary in shape to the grooves in the leg frames, the ridge of each connection block fitting within and being connected to a respective groove; and a plurality of wheel assemblies, each having a respective connection block mounted thereon, so that each end of the front leg frame and the fear leg frame is provided with a respective wheel assembly.

2. The folding chair as claimed in claim 1, wherein each wheel assembly comprises a threaded stem, a wheel fork, a bearing connected with the threaded stem and disposed within the wheel fork, and a wheel pivotally connected within the wheel fork, the threaded stem being screwed into a bottom of the respective connection block.

3. The folding chair as claimed in claim 1, wherein each ends of the grooves comprises a plurality of through holes, each of the connection blocks comprises a plurality of connection screw holes corresponding to the through holes; further comprising bolts that pass through the connection screw holes and the through holes, thereby connecting the connection blocks to the grooves.

4. The folding chair as claimed in claim 1, wherein the wheel assemblies mounted on the front leg frame are at a side away from the seat, and the wheel assemblies mounted on the rear leg frame are at a side toward the seat.

* * * * *